US009410563B2

(12) United States Patent
Cheng

(10) Patent No.: US 9,410,563 B2
(45) Date of Patent: Aug. 9, 2016

(54) PNEUMATIC MOTOR AND PNEUMATIC VALVE FOR THE SAME

(71) Applicant: Ming-Ta Cheng, Taichung (TW)

(72) Inventor: Ming-Ta Cheng, Taichung (TW)

( * ) Notice: Subject to any disclaimer, the term of this patent is extended or adjusted under 35 U.S.C. 154(b) by 346 days.

(21) Appl. No.: 14/066,486

(22) Filed: Oct. 29, 2013

(65) Prior Publication Data

US 2015/0114213 A1 Apr. 30, 2015

(51) Int. Cl.

| | |
|---|---|
| ***F15B 15/02*** | (2006.01) |
| ***F01C 20/04*** | (2006.01) |
| ***F01C 21/18*** | (2006.01) |
| *F01C 1/344* | (2006.01) |

(52) U.S. Cl.

CPC ..... *F15B 15/02* (2013.01); *F01C 20/04* (2013.01); *F01C 21/18* (2013.01); *F01C 1/344* (2013.01)

(58) Field of Classification Search

CPC ..... F01C 1/356; F01C 13/02; F01C 20/08; F01C 20/14; F01C 2021/1625; F01C 21/18; F01L 7/022; F01L 7/023; F01L 7/024; F01L 29/06; F01L 29/08; F16K 3/08; F16K 3/085

See application file for complete search history.

(56) References Cited

U.S. PATENT DOCUMENTS

| | | | | |
|---|---|---|---|---|
| 2,677,391 A * | 5/1954 | Chellberg | F01L 29/06 | 137/624.13 |
| 2,733,687 A * | 2/1956 | Schmid | B25B 21/00 | 418/133 |
| 3,429,230 A * | 2/1969 | Quackenbush | F01C 21/18 | 418/270 |
| 4,708,210 A * | 11/1987 | Rahm | B25F 5/00 | 173/169 |
| 5,022,469 A * | 6/1991 | Westerberg | B23Q 11/0078 | 173/170 |
| 6,241,500 B1 * | 6/2001 | Ellis | B25B 21/02 | 418/1 |
| 7,040,414 B1 * | 5/2006 | Kuo | B25B 21/00 | 173/169 |

* cited by examiner

*Primary Examiner* — Nathaniel Wiehe
*Assistant Examiner* — Matthew Wiblin
(74) *Attorney, Agent, or Firm* — Birch, Stewart, Kolasch & Birch, LLP

(57) ABSTRACT

A pneumatic motor includes a housing, a rotor, an air flowing unit and an air-supply unit. The housing has an inside space formed along an axis and divided sequentially into a rotor chamber, a valve chamber and an inlet chamber. The rotor is rotatably mounted in the rotor chamber. The pneumatic valve is mounted in the rotor chamber and the valve chamber and includes an air flowing unit and an adjusting gate. The air-supply unit is mounted in the inlet chamber and is connected to a source of compressed air, so the compressed air can flow from the inlet chamber into the valve chamber and then flow through the pneumatic valve to drive the rotor.

8 Claims, 11 Drawing Sheets

PNEUMATIC MOTOR AND PNEUMATIC VALVE FOR THE SAME

BACKGROUND OF THE INVENTION

1. Field of the Invention

The present invention relates to a pneumatic tool, and more particularly to a pneumatic motor and a pneumatic valve.

2. Description of Related Art

A conventional pneumatic motor is mounted in a pneumatic tool and is rotated by compression air for driving the pneumatic tool to do repeating mechanical operations, such as rotation or movement.

With reference to FIG. 9, a conventional pneumatic motor 70 includes a housing 71, which accommodates a rotor 72, a pneumatic valve 73, and an air-supply unit 74 in sequence.

With further reference to FIGS. 10 and 11, the pneumatic valve 73 includes an air flowing unit 731 and an adjusting gate 732. The air flowing unit 731 is disk-shaped and has a back, a front and a center. A fixing hole 7311 is formed in the back of the air flowing unit 731 through the center. Two air-flowing openings 7312 are curved and are formed in the air flowing unit 731 and are located above the fixing hole 7311. Two air-flowing passages 7313 are formed in the front of the air flowing unit 731. Each air-flowing passage 7313 is connected to one of the air-flowing openings 7312.

The adjusting gate 732 rotatably abuts against the back of the air flowing unit 731 and has a back, a front and a top. An air-in passage 7321 is L-shaped and is formed from the back to the top of the adjusting gate 732. An air outlet 7322 is formed in the front of the adjusting gate 732 and communicates with the air-in passage 7321.

With reference FIGS. 9 to 11, when the air-supply unit 74 leads compressed air into the housing 71, the compressed air will flow into the adjusting gate 732. The adjusting gate 732 is able to rotate and switch positions for communicating one of the air-flowing openings 7312 with the air outlet 7322. The compressed air is able to flow out of the air-flowing passage 7313 via the air outlet 7322 and the air-flowing opening 7312 and to drive the rotor 72 to rotate. The other non-in-use air-flowing opening 7312 of the air flowing unit 731 is able to release part of the compressed air to prevent the back pressure from generating inside the housing 71 and to keep the rotation of the rotor 72 smooth.

The compressed air will flow up to hit the inner surface of the air-in passage 7321 when the compressed air flows out from the air outlet 7322 via the L-shaped air-in passage 7321. The adjusting gate 732 will be pushed backward in the horizontal direction of the compressed air and cannot abut against the air flowing unit 731 closely. Therefore, a gap will be formed between the adjusting gate 732 and the air flowing unit 731, and part of the compressed air will flow out from the gap. Thus, the compressed air cannot flow into the air flowing unit 731 completely and will decrease the speed of the rotor 72.

To overcome the shortcomings of the conventional pneumatic motor, the present invention provides a pneumatic motor and a pneumatic valve to mitigate or obviate the aforementioned problems.

SUMMARY OF THE INVENTION

A pneumatic motor includes a housing, a rotor, a pneumatic valve and an air-supply unit. The housing has an axis and an inside space formed along the axis and divided sequentially into a rotor chamber, a valve chamber and an inlet chamber. The rotor is rotatably mounted in the rotor chamber.

The pneumatic valve is mounted in the rotor chamber and the valve chamber and includes an air flowing unit and an adjusting gate. The air flowing unit is cylindrical and is mounted adjacent in a rear side of the rotor chamber, and has a front surface and a back surface opposite to the front surface. Two air-flowing openings are curved and are symmetrically formed through the front surface to the back surface. Two air-flowing passages are symmetrically formed in the front surface and communicate with the air-flowing openings respectively. An air-outlet recess is curved and formed in the back surface. Two air-outlet holes are formed through the periphery of the air flowing unit and communicating with the air-outlet recess.

The adjusting gate is mounted in the valve chamber and abuts closely against the back surface of the air flowing unit and has a front side and a rear side opposite to the front side. An outlet opening is formed through the front side and positioned corresponding to one of the air-flowing openings. An air-flowing recess is curved and formed in the front side. An air inlet is formed in the center of the rear side of the adjusting gate. Multiple air-outlet holes are formed through the periphery of the adjusting gate and communicating with the air inlet.

The air-supply unit is mounted in the inlet chamber and connected to a source of compressed air for flowing the compressed air from the inlet chamber into the valve chamber for driving the rotor.

Other objects, advantages, and novel features of the invention will become more apparent from the following detailed description when taken in conjunction with the accompanying drawing.

DETAILED DESCRIPTION OF PREFERRED EMBODIMENT

With reference to FIGS. 1 to 6, a preferred embodiment of a pneumatic motor in accordance with the present invention has a housing 10, a rotor 20, a pneumatic valve 30 and an air-supply unit 40.

Figure 1:
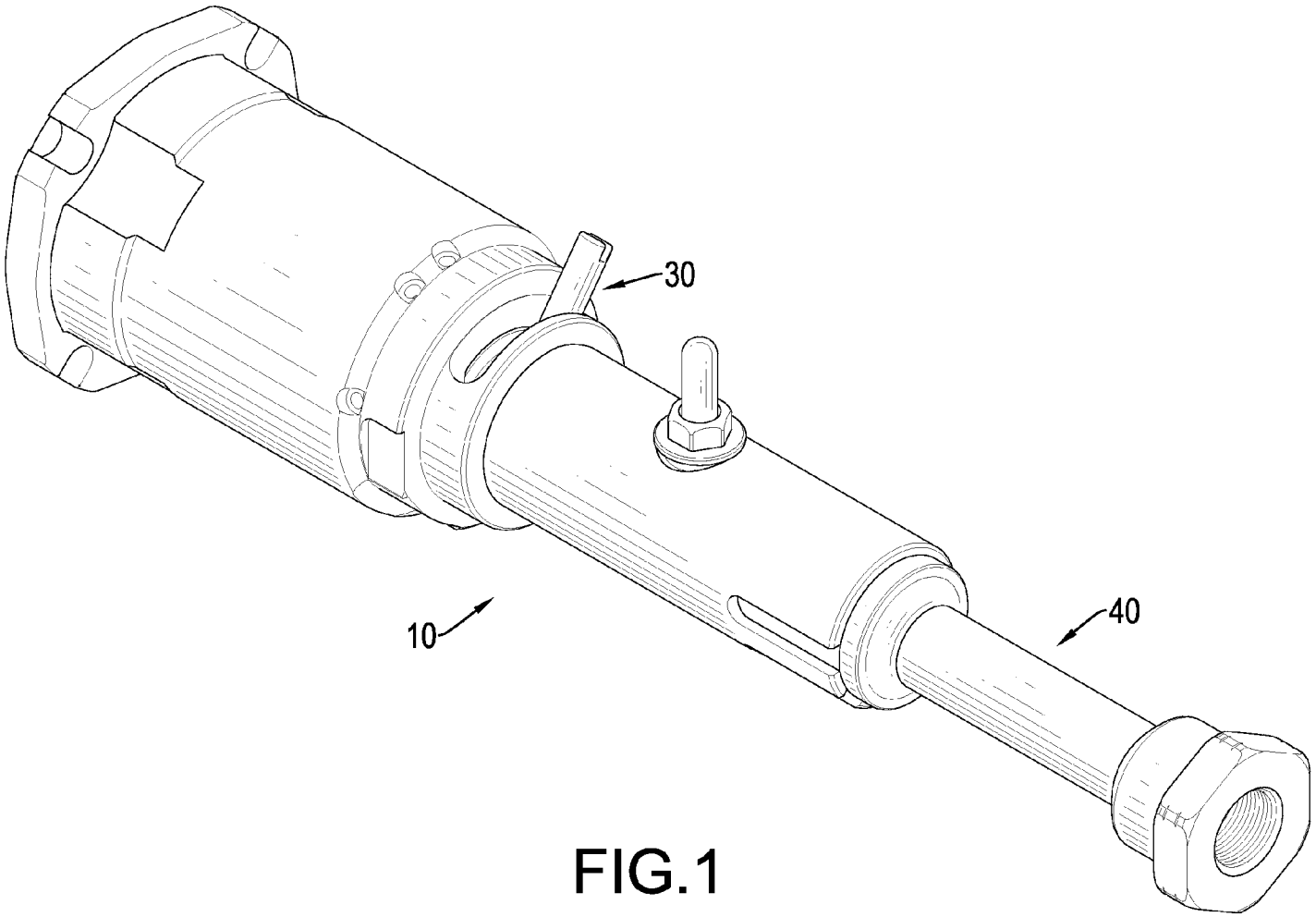
FIG. 1 is a perspective view of a pneumatic motor with a pneumatic valve in accordance with the present invention.
Figure 2:
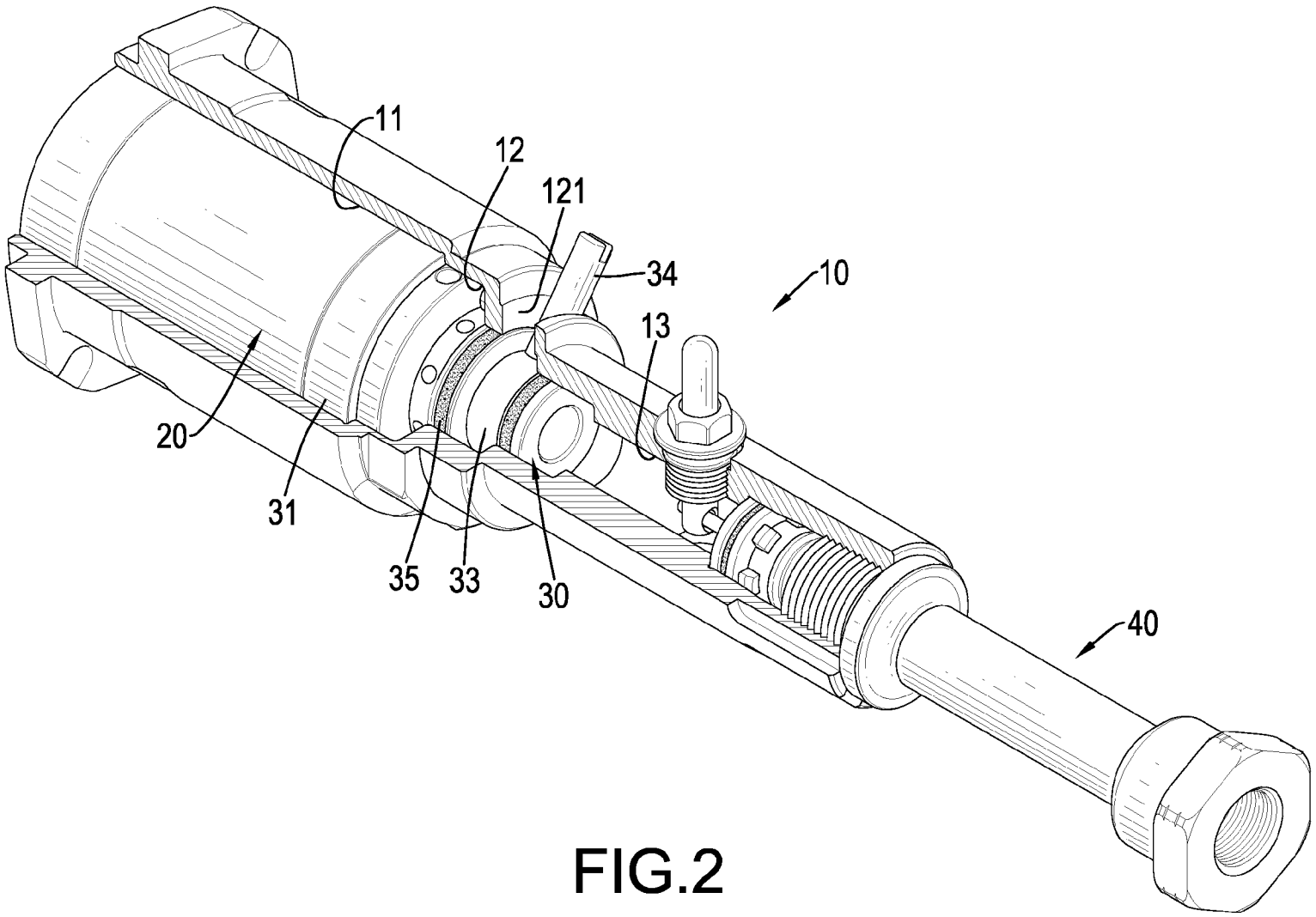
FIG. 2 is a perspective view in partial section of the pneumatic motor in FIG. 1.
Figure 6:
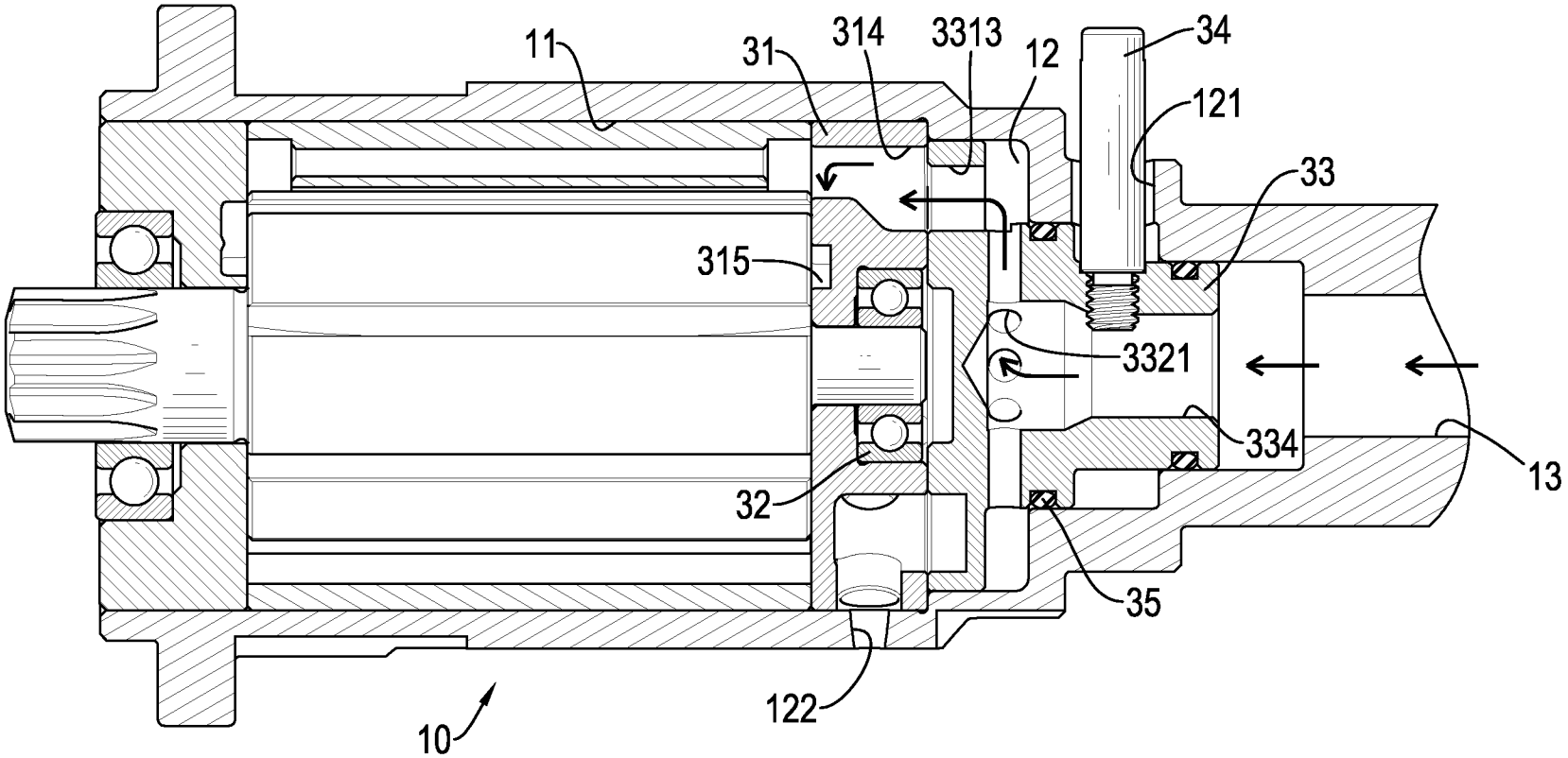
FIG. 6 is an operational side view in partial section of the pneumatic motor along line 6-6 in FIG. 5.

With reference to FIGS. 1 and 2, the left side of FIG. 1 is defined as a front side and the right side of FIG. 1 is defined as a rear side. The housing 10 is elongated and tubular and has an inside space formed and defined along an axis of the housing 10. The inside space is divided into a rotor chamber 11, a valve chamber 12 and an inlet chamber 13 from the front side to the rear side. A rod groove 121 is formed through a periphery of the housing 10 and corresponds in position to the valve chamber 12. With reference to FIG. 6, multiple outlets 122 are formed through the periphery of the housing 10 and correspond in position to the rotor chamber 11.

With reference to FIG. 2, the rotor 20 is rotatably mounted in the rotor chamber 11 and has a shaft.

Figure 3:
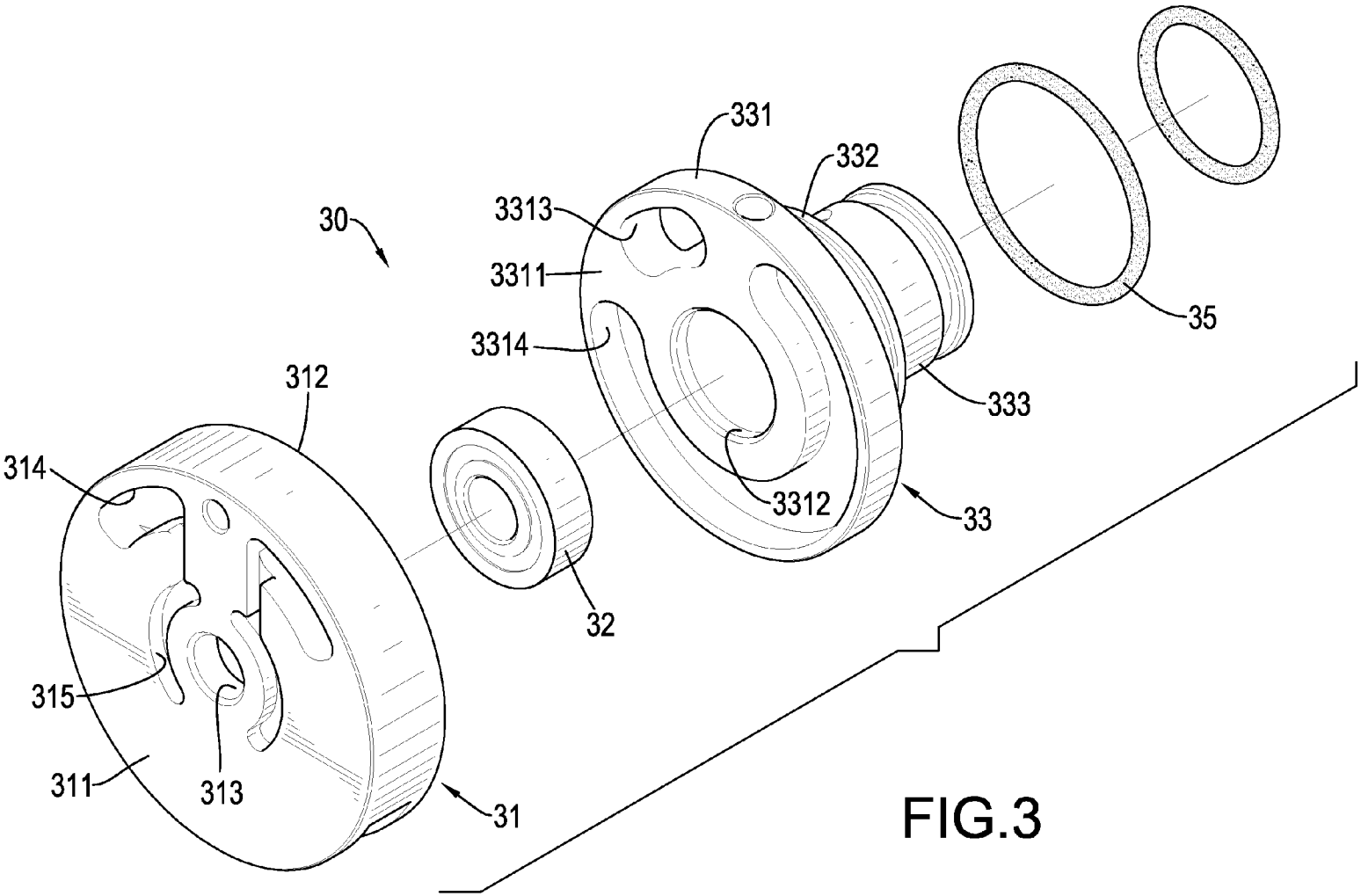
FIG. 3 is an exploded perspective view of a pneumatic valve in FIG. 1.

With reference to FIGS. 2 and 3, the pneumatic valve 30 is mounted in the rotor chamber 11 and the valve chamber 12 and includes an air flowing unit 31, a bearing 32, an adjusting gate 33, an adjusting rod 34 and two sealing rings 35.

Figure 4:
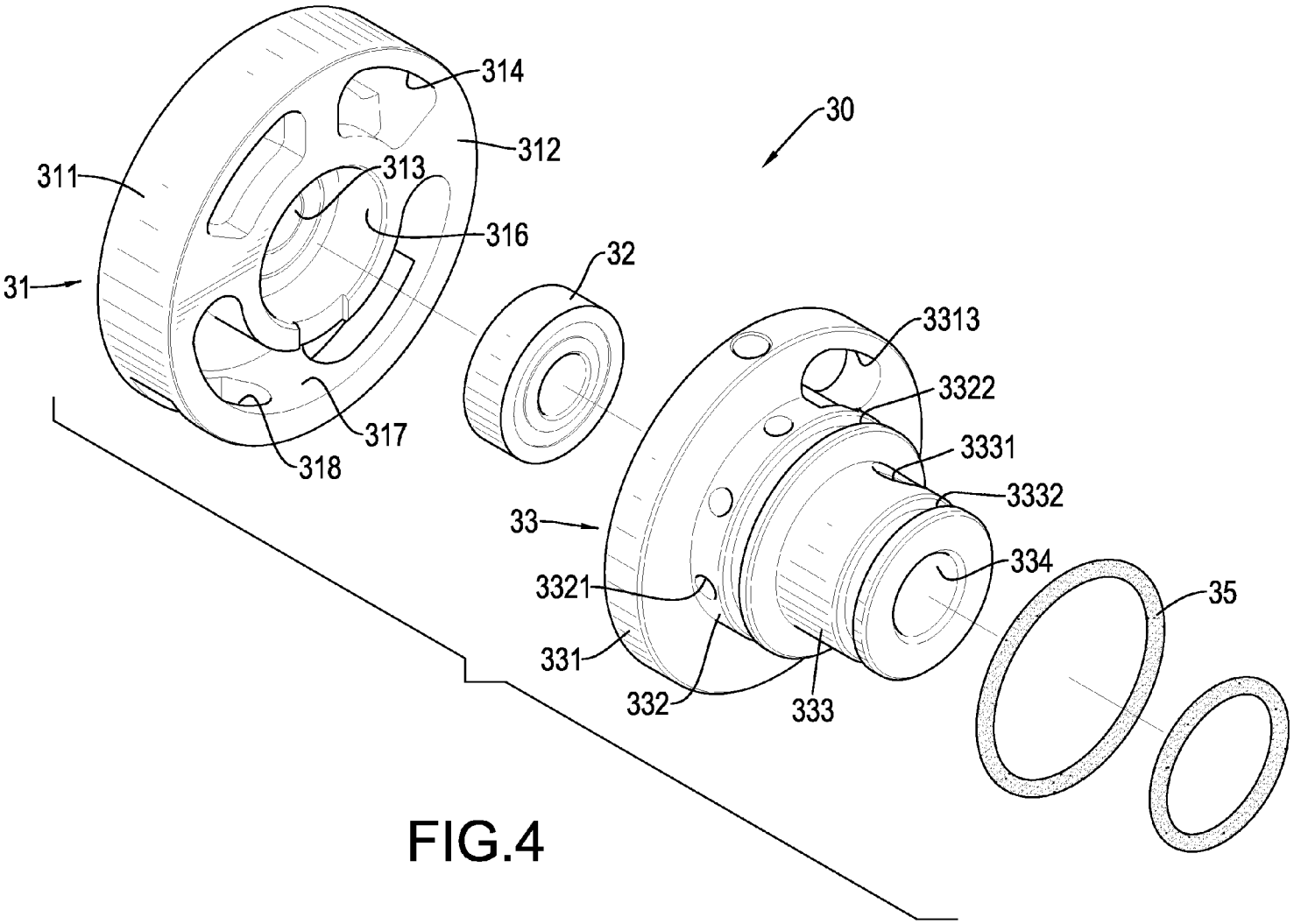
FIG. 4 is another exploded perspective view of the pneumatic valve in FIG. 1.

With reference to FIGS. 3 and 4, the air flowing unit 31 is cylindrical, is mounted adjacent to the rear side of the rotor chamber 11 and has a front surface 311 and a back surface 312. An axis hole 313 is formed through a center of the front surface 311. The shaft of the rotor 20 is mounted rotatably in the axis hole 313. Two air-flowing openings 314 are curved and are symmetrically formed through the front surface 311 to the back surface 312. Two air-flowing passages 315 are symmetrically formed in the front surface 311. One end of each air-flowing passage 315 is respectively connected to each air-flowing opening 314, and the other end of each air-flowing passage 315 is formed as a curved shape disposed around the axis hole 313. A bearing recess 316 is formed in the back surface 312 and communicates with the axis hole 313. An inner diameter of the bearing recess 316 is larger than an inner diameter the axis hole 313. An air-outlet recess 317 is curved, is formed in the back surface 312, and is located opposite to the two air-flowing openings 314. Two air-outlet holes 318 are slotted holes and are formed through a periphery of the air flowing unit 31 and communicate with the air-outlet recess 317.

With reference to FIGS. 4 and 6, the bearing 32 is rotatably mounted in the bearing recess 316. The shaft of the rotor 20 connects with the bearing 32.

With reference to FIGS. 2 to 4, the adjusting gate 33 is mounted in the valve chamber 12 and abuts closely against the back surface 312 of the air flowing unit 31. The adjusting gate 33 includes an abutting portion 331, an air-outlet portion 332, an air entrance portion 333 and an air inlet 334.

The abutting portion 331 is disk-shaped and has a front side 3311 and a rear side. A bearing recess 3312 is formed in a center of the front side 3311 for accommodating the bearing 32. An outlet opening 3313 is formed through the front side 3311 of the abutting portion 331 and is positioned corresponding to one of the air-flowing openings 314. The shape of the outlet opening 3313 corresponds to the shape of the air-flowing opening 314. An air-flowing recess 3314 is curved and formed in the front side 3311 of the abutting portion 331 and is located around the bearing recess 3312. The air-flowing recess 3314 has an arc length that is about a three-fourth circle. When the air flowing unit 31 is rotated, the air-flowing recess 3314 will move to cover the air-outlet recess 317 and one of the air-flowing openings 314, such that the air-outlet recess 317 and said air-flowing opening 314 communicate with each other for air discharging.

The air-outlet portion 332 and the air entrance portion 333 are integrally connected to the rear side of the abutting portion 331 sequentially. The air inlet 334 is formed through a center of the air entrance portion 333 and extends to the air-outlet portion 332. Multiple air-outlet holes 3321 are formed through a periphery of the air-outlet portion 332 and communicate with the air inlet 334 for discharging the compressed air that is in the air inlet 334. A first sealing ring groove 3322 is annular and is formed around the periphery of the air-outlet portion 332 and is positioned adjacent to the air-outlet holes 3321. A rod hole 3331 is formed in a periphery of the air entrance portion 333 and is aligned with the rod groove 121. A second sealing ring groove 3332 is formed around the periphery of the air entrance portion 333.

With reference to FIGS. 4 and 6, the adjusting rod 34 is inserted into the rod groove 121 and is mounted in the rod hole 3331. The adjusting rod 34 can be pulled or pushed along the rod groove 121 in order to switch the direction of the adjusting gate 33.

With reference to FIGS. 4 and 6, one of the two sealing rings 35 is fitted in the first sealing ring groove 3322, and the other sealing ring 35 is fitted in the second sealing ring groove 3332. The sealing rings 35 abut an inside of the housing 10 to make the valve chamber 12 an airtight space. Thus, the compressed air that flows into the valve chamber 12 will be kept inside the valve chamber 12 and will not flow from the valve chamber 12 to the inlet chamber 13.

With reference to FIG. 2, the air-supply unit 40 is mounted in the inlet chamber 13 and is connected to a source of compressed air. The compressed air is able to flow from the inlet chamber 13 into the valve chamber 12 and flow through the pneumatic valve 30 to the rotor 20. The rotor 20 will be driven by the compressed air and is able to rotate in a specific direction, e.g. clockwise or counterclockwise by pulling or pushing the adjusting rod 34.

Figure 5:
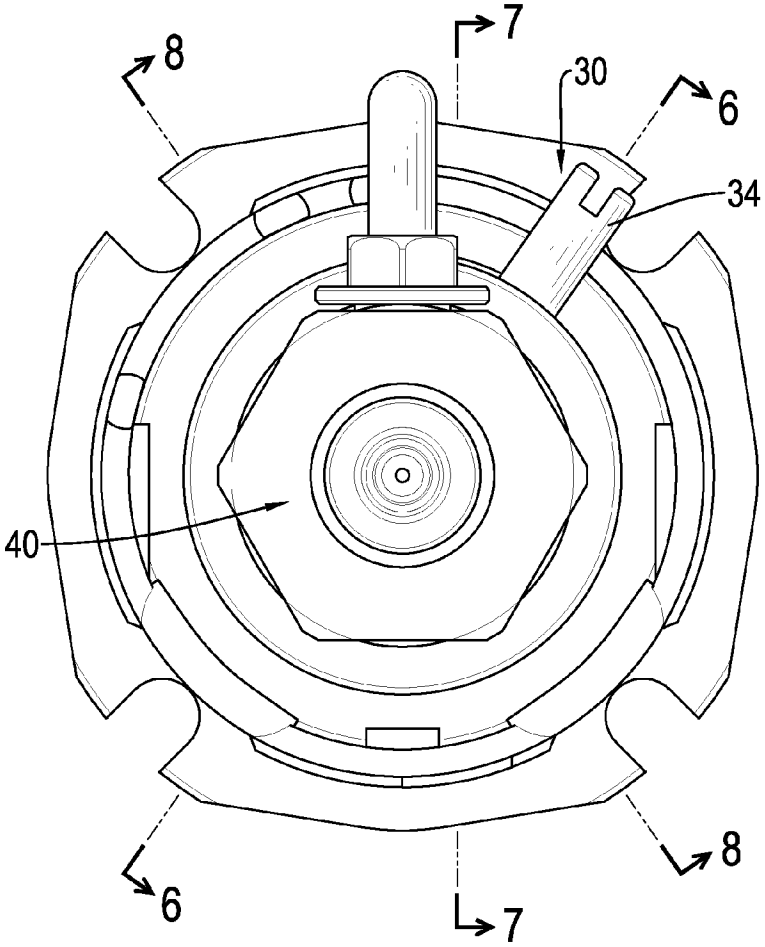
FIG. 5 is a rear view of the pneumatic motor in FIG. 1.
Figure 7:
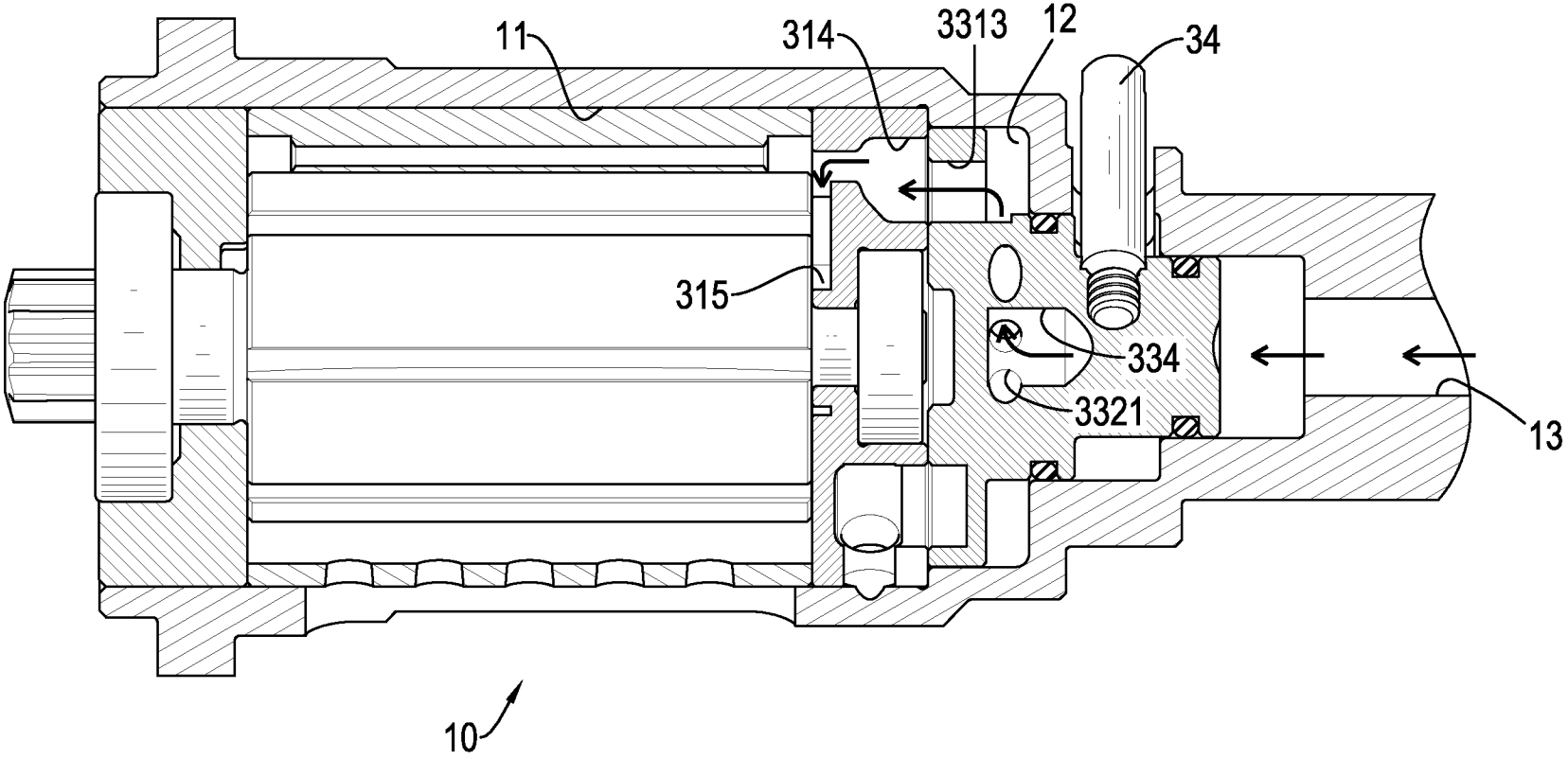
FIG. 7 is an operational side view in partial section of the pneumatic motor along line 7-7 in FIG. 5.

With reference to FIGS. 2 and 5, when the adjusting rod 34 is pulled to one end of the rod groove 121, the adjusting gate 33 will rotate and the outlet opening 3313 is aligned with one of the air-flowing openings 314. With reference to FIGS. 6 and 7, the compressed air flows into the air inlet 334 and flows out from the air-outlet holes 3321. The compressed air will enter the valve chamber 12 and flow into the outlet opening 3313, the air-flowing opening 314 and flow out from the air-flowing passage 315. Finally, the compressed air flows out from the pneumatic valve 30, flows into the rotor chamber 11 and then drives the rotor 20 to rotate in a specific direction (e.g. clockwise). When the adjusting rod 34 is pushed to the opposite end of the groove 121, the adjusting gate 33 and the rotor 20 will rotate in a reverse direction.

Figure 8:
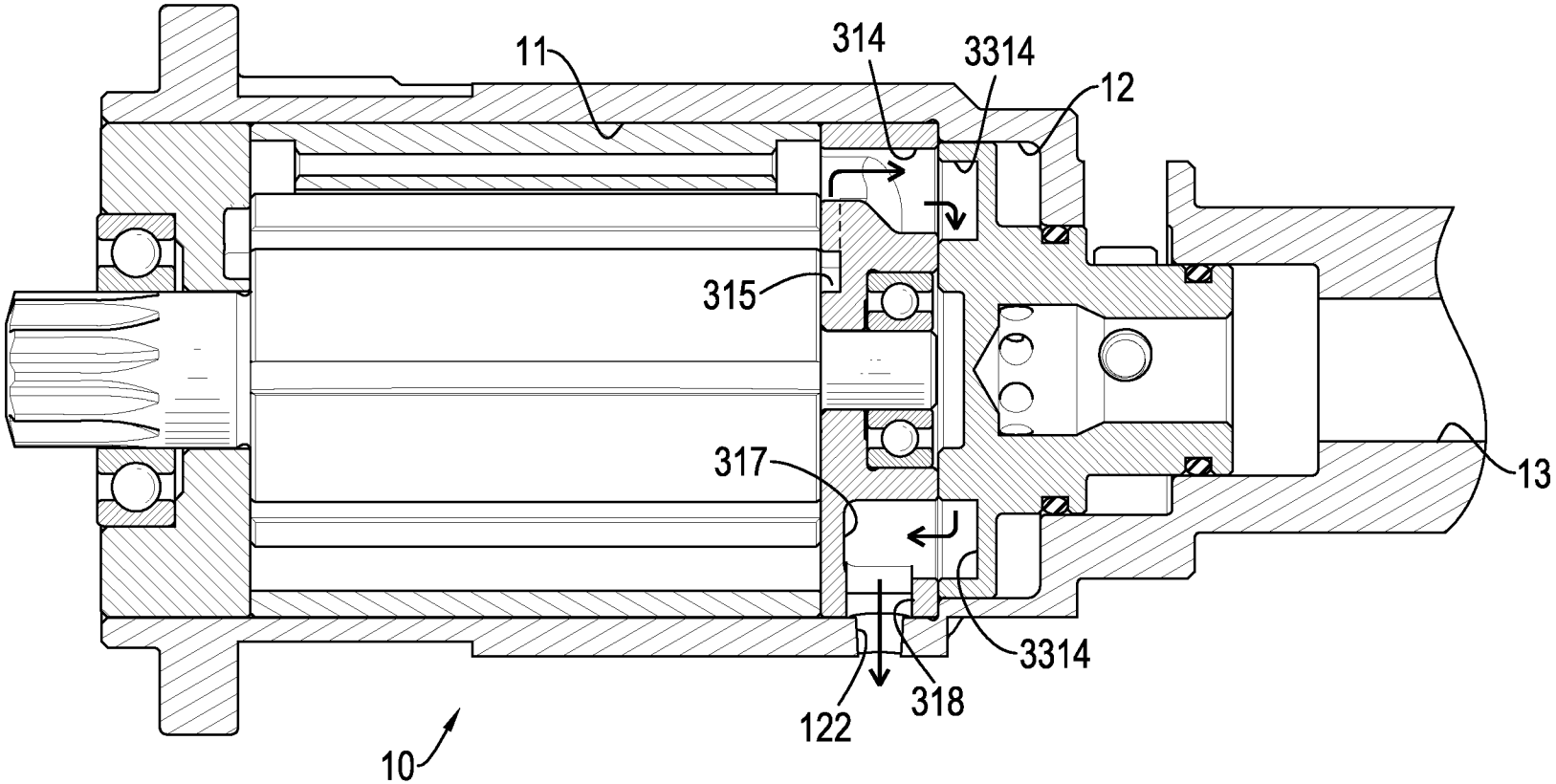
FIG. 8 is an operational side view in partial section of the pneumatic motor along line 8-8 in FIG. 5.
Figure 9:
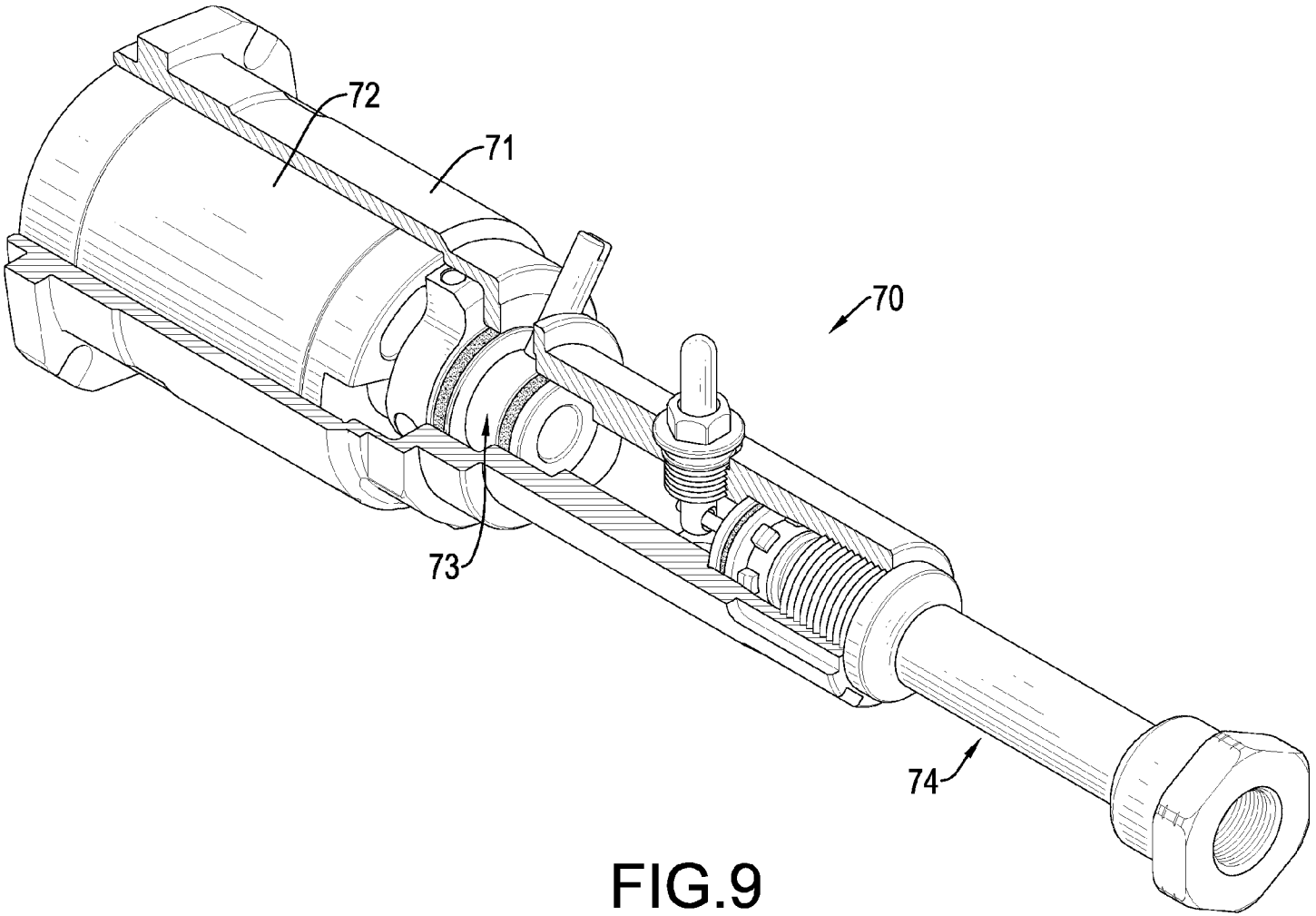
FIG.9 PRIOR ART
FIG. 9 is a perspective view in partial section of a conventional pneumatic motor.
Figure 10:
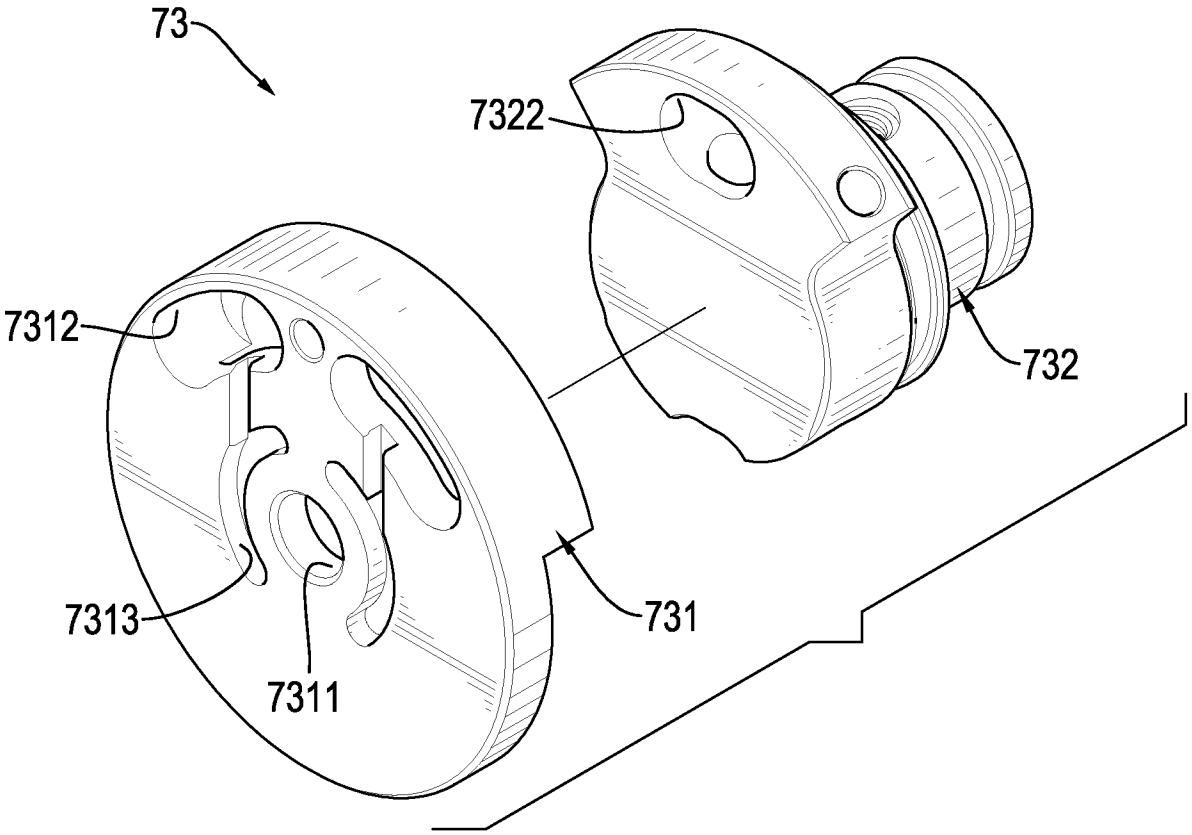
FIG.10 PRIOR ART
FIG. 10 is an exploded perspective view of a pneumatic valve of the conventional pneumatic motor in FIG. 9.
Figure 11:
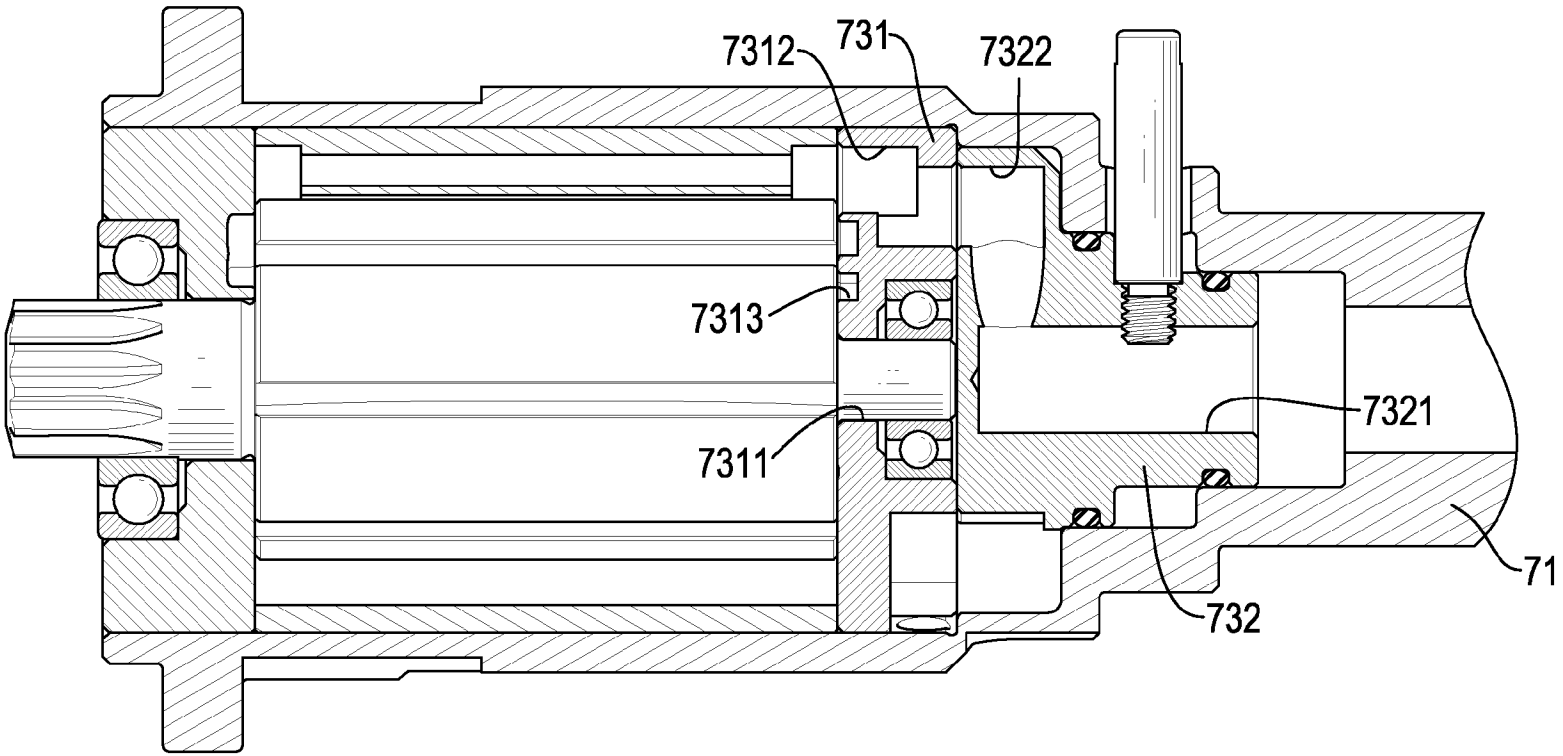
FIG.11 PRIOR ART
FIG. 11 is an operational side view in partial section of the conventional pneumatic motor in FIG. 9.

With reference to FIG. 8, in order to avoid the back pressure from generating while the rotor 20 is rotating, part of the compressed air has to be discharged. Thus, part of the compressed air flows along one of the air-flowing passages 315 to the aligned air-flowing opening 314 via the air-flowing recess 3314 and the air-outlet recess 317, and is then discharged from the two air-outlet holes 318 to the outlets 122 of the housing 10.

When the compressed air flows into the air flowing unit 31 and flows out from the air-outlet holes 3321, the valve chamber 12 will be fully filled with the compressed air. Therefore, the compressed air flowing into the outlet opening 3313 generates a horizontal force to push the abutting portion 331 of the adjusting gate 33 to abut against the back surface 312 of the air flowing unit 31.

Accordingly, the abutting portion 331 and the air flowing unit 31 abut against each other closely and no gap exists between the abutting portion 331 and the air flowing unit 31 such that the compressed air completely flows into the adjusting gate 33 and the air flowing unit 31 to drive the rotor 20 to rotate efficiently.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic motor comprising:

a housing having an axis;

an inside space formed along the axis and divided sequentially into a rotor chamber;

a valve chamber; and an inlet chamber;

a rotor rotatably mounted in the rotor chamber;

a pneumatic valve mounted in the rotor chamber and the valve chamber and including an air flowing unit being cylindrical and mounted adjacent in a rear side of the rotor chamber, and having a front surface;

a back surface opposite to the front surface;

two air-flowing openings being curved and symmetrically formed through the front surface to the back surface;

two air-flowing passages symmetrically formed in the front surface and communicating with the air-flowing openings respectively;

an air-outlet recess being curved and formed in the back surface;

two air-outlet holes formed through a periphery of the air flowing unit and communicating with the air-outlet recess;

an adjusting gate mounted in the valve chamber and abutting closely against the back surface of the air flowing unit and having a front side;

a rear side being opposite to the front side;

an outlet opening formed through the front side to the rear side and positioned corresponding to one of the air-flowing openings;

an air-flowing recess being curved and formed in the front side of the adjusting gate;

an air inlet formed through the center of the rear side of the adjusting gate;

multiple air-outlet holes formed through a periphery of the adjusting gate and communicating with the air inlet;

an air-supply unit mounted in the inlet chamber and connected to a source of compressed air for flowing the compressed air from the inlet chamber into the valve chamber for driving the rotor.

2. The pneumatic motor as claimed in claim 1, wherein the adjusting gate includes an abutting portion, an air-outlet portion, and an air entrance portion that are integrally connected sequentially;

the abutting portion is disk-shaped;

the front side of the adjusting gate is positioned on the abutting portion; and the air inlet is defined in the center of the air entrance portion and extends to the air-outlet portion.

3. The pneumatic motor as claimed in claim 2, wherein an arc length of the air-flowing recess is a three-fourth circle.

4. The pneumatic motor as claimed in claim 1, wherein an arc length of the air-flowing recess is a three-fourth circle.

5. A pneumatic valve comprising:

an air flowing unit being cylindrical and having a front surface;

a back surface being opposite to the front surface;

two air-flowing openings being curved and symmetrically formed through the front surface to the back surface;

two air-flowing passages symmetrically formed in the front surface and communicating with the air-flowing openings respectively;

an air-outlet recess being curved and formed in the back surface;

two air-outlet holes formed through a periphery of the air flowing unit and communicating with the air-outlet recess;

an adjusting gate abutting closely against the back surface of the air flowing unit and having a front side;

a rear side being opposite to the front side;

an outlet opening formed through the front side to the rear side and positioned corresponding to one of the air-flowing openings;

an air-flowing recess being curved and formed in the front side of the adjusting gate; an air inlet formed through the center of the rear side of the adjusting gate;

multiple air-outlet holes formed through a periphery of the adjusting gate and communicating with the air inlet.

6. The pneumatic valve as claimed in claim 5, wherein the adjusting gate includes an abutting portion, an air-outlet portion, and an air entrance portion integrally connected sequentially;

the abutting portion is disk-shaped;

the front side of the adjusting gate is positioned on the abutting portion; and the air inlet is defined in the center of the air entrance portion and extends to the air-outlet portion.

7. The pneumatic valve as claimed in claim 6, wherein an arc length of the air-flowing recess is a three-fourth circle.

8. The pneumatic valve as claimed in claim 5, wherein an arc length of the air-flowing recess is a three-fourth circle.

* * * * *